United States Patent [19]

Shigihara et al.

[11] 3,980,284

[45] Sept. 14, 1976

[54] APPARATUS FOR PREVENTING SOLIDIFICATION OF MOLTEN METAL IN AN ELECTRO-MAGNETIC PUMP FOR SUPPLYING THE MOLTEN METAL

[75] Inventors: Shigeyuki Shigihara; Mitsuji Karita; Hideo Ikeguchi, all of Ise, Japan

[73] Assignee: Shinko Electric Co., Ltd., Tokyo, Japan

[22] Filed: Nov. 25, 1974

[21] Appl. No.: 526,792

[30] Foreign Application Priority Data

Dec. 6, 1973 Japan ..... 48-138327

[52] U.S. Cl. ..... 266/237; 164/147; 164/257; 417/50

[51] Int. Cl.[2] ..... F27D 3/14

[58] Field of Search ..... 164/251, 257, 281, 63, 164/147; 417/50; 310/11; 222/DIG. 2; 266/34 A, 38, 236, 237, 238

[56] References Cited

UNITED STATES PATENTS

| | | | |
|---|---|---|---|
| 2,541,841 | 2/1951 | Tama | 417/50 |
| 2,552,876 | 5/1951 | Tama | 417/50 |
| 2,558,698 | 6/1951 | Wade | 417/50 |
| 2,756,678 | 7/1956 | Collins | 417/50 |
| 3,198,119 | 8/1965 | Mead | 417/50 |
| 3,754,634 | 8/1973 | Gerbig | 417/50 |

*Primary Examiner*—Roy Lake
*Assistant Examiner*—Paul A. Bell
*Attorney, Agent, or Firm*—James E. Nilles

[57] ABSTRACT

In supplying molten metal to a mold by means of an electromagnetic pump mounted on a metal container, the molten metal received in the pump is held in high temperature by means of partition walls longitudinally extending in the pump, even when the supply of molten metal is suspended for a long period. The partition walls define several passageways. In this period of suspension the driving force of travelling magnetic field is directed to the molten metal container and causes circulation of molten metal through central passageway and side passageways. Through this circulation molten metal in the pump is substantially replaced by molten metal in the container, thus making it possible to prevent solidification of molten metal in the pump by maintaining high temperature therein.

5 Claims, 9 Drawing Figures

APPARATUS FOR PREVENTING SOLIDIFICATION OF MOLTEN METAL IN AN ELECTRO-MAGNETIC PUMP FOR SUPPLYING THE MOLTEN METAL

BACKGROUND OF THE INVENTION

The present invention relates to an apparatus for preventing solidification of molten metal in an electromagnetic pump. In particular, the apparatus according to the present invention is adapted to be used when the molten metal in a container is supplied to molds or the like by means of an electromagnetic pump with the supply of molten metal being intermittently suspended for considerably long time.

In supplying molten metal to a mold by means of an electromagnetic pump mounted on a metal container, the molten metal received in the container is held in high temperature due to the high insulating characteristic of the container itself by actuating the heater provided thereon, thus being prevented from solidifying at least for a certain period.

However, the molten metal in the electromagnetic pump provided on the container will alter into solid state as the temperature thereof is lowered after certain period of suspension in supplying molten metal into the molds or the like, although no problem is caused in the course of continuous supply. This is a matter of natural consequence because the molten metal of unit volume received in the electromagnetic pump must contact with the inner wall surface of lower temperature and of larger area than in the container. Therefore, it was heretofore necessary in the operation of molten metal supply to limit the amount of molten metal in the container to a certain amount of an uninterrupted and exhaustive supply of molten metal. Such manner of supply has caused the inconveniences in the operation of molten metal supply.

To overcome the above mentioned difficulties, it was proposed to inverse the direction of travelling magnetic field in the electromagnetic pump. By inversing the direction of travelling magnetic field, the surface of the molten metal in the electromagnetic pump is lowered in relation to the level of molten metal surface in the container, while the circulation of molten metal is generated as will be explained below.

The driving force in electromagnetic pump to push molten metal into the container is largest in the central portion thereof and is decreased at the both sides thereof by degrees. (This is well known as the lateral edge effect and is substantiated through experiments.) Such distribution of driving force generates the circulation of molten metal wherein the central flow is directed to the container and the side flows are directed to the outlet of the pump. Since the driving force generated by travelling magnetic field is so feeble at the position where the electromagnetic pump is connected to the container, the molten metal around the position of connection fails to be transferred to the full inside of the container and tends to return, that is, to flow upwardly along the both sides of molten metal conduit. (The decrease of driving force at the longitudinal edge is well known as longitudinal edge effect.)

It was found that the above mentioned circulation of molten metal flow functions to check solidification of molten metal to a certain extent, but it was impossible to substantially prevent the drop of molten metal temperature, thus bringing about the defects such as nonuniformity or the inferiority of resulted articles. Summary of the Invention It is therefore the object of the present invention to keep the molten metal in electromagnetic pump in substantially the same temperature as that in a container in spite of the suspension of molten metal supply, by means of partition walls provided on the molten metal inlet in the electromagnetic pump where the pump is connected to the container. These partition walls serve to continuously exchange the molten metal in the pump with that in the container.

The detailed construction of the apparatus according to the present invention will be explained hereinafter with reference to the accompanied drawings wherein:

Figure 1:
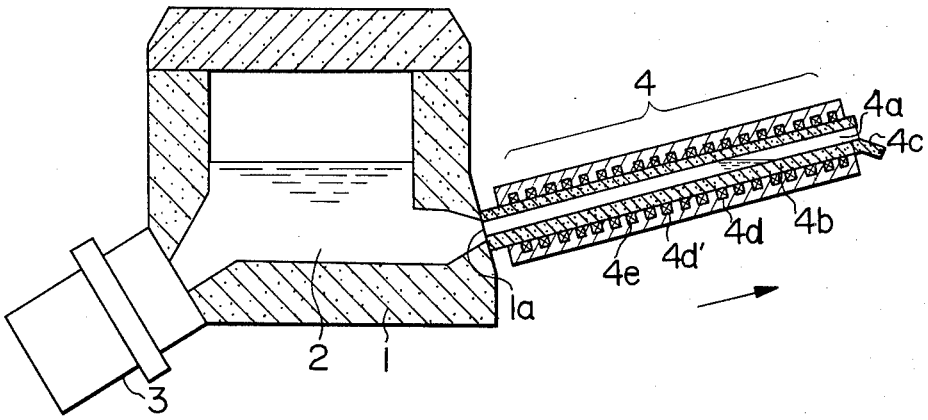
FIG. 1 is a sectional view of the entire device according to the present invention.

A container which is referred to in each of the drawings by numeral 1 is made of refractory material and receives molten metal 2 which is liquidized through melting process. Numeral 3 indicates a heater which is mounted on the container 1 to continuously supply heat to the molten metal 2 for preventing drop of the temperature thereof. Numeral 4 indicates an electromagnetic pump which exemplifies the present invention and which comprises a refractory wall **4*b* defining a molten metal conduit 4a, a molten metal supply outlet 4*c* attached to the top of the molten metal conduit 4*a*, an iron core 4*d* disposed around the refractory wall 4*b* to receive the conduit 4*a* between the upper and lower portions of the core, an AC coil 4*e* received in grooves 4*d*′ of the iron core 4*d* and partition walls 4b′ incorporated to the refractory wall 4*b* as an independent member or in one unit. The partition wall 4*b*′** will be explained below in detail.

The electromagnetic pump 4 having the above mentioned members is connected to the container 1 in such manner that the edge of the conduit **4*a* opposed to the outlet 4*c* is secured to the outelt 1*a* of the container located in the lower part of the container 1. The pump 4** is directed upwardly and slantedly.

Figure 2:
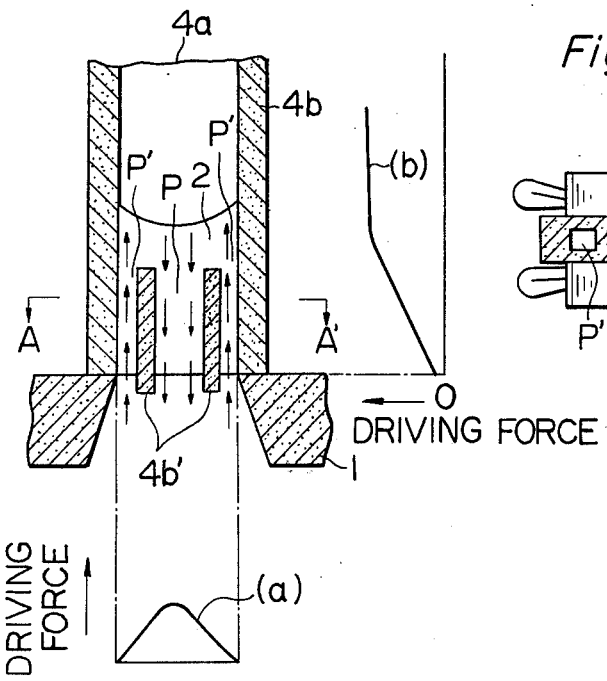
FIG. 2 is a view of the essential portion of the device according to the present invention and indicates the principle of function obtainable by the present invention.
Figure 3:
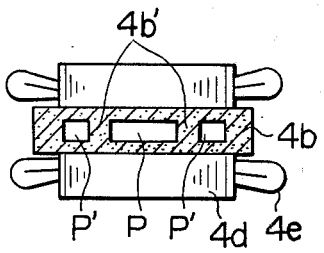
FIG. 3 is a sectional view taken along the line A—A′ in FIG. 2.

The conduit **4*a* is influenced by the travelling magnetic field across its full width. The above mentioned partition walls 4*b*′ according to the present invention are, as shown in FIG. 2 and FIG. 3, located in the molten metal conduit 4*a* so as to divide the conduit into three passageways. A central passageway P is larger than side passageways P′** in width, and this is because the driving force applied to molten metal at the central portion of a passageway is larger in the broader passageway than in the narrower passageway as a result of variation in inductive efficiency.

Next, the arrangement of the partition walls 4b' in its longitudinal direction comes into question. With regard to this it is preferable that the partition walls *4b'* extrudes over the edge of the pump 4 into the container 1 as shown in FIG. 2 so that the molten metal in the electromagnetic pump 4 may be sure to be introduced into the container 1 through the central passageway by virtue of the travelling magnetic field directed to the container 1. It will be however understood that, for the purpose of facilitating production of the apparatus, the edge of the partition walls *4b'* may be recessed from the edge or the set position of the pump 4 so far as the molten metal in the pump 4 can be guided through the central passageway P into the container 1. On the other hand, the partition walls *4b'* extend upwardly and slantedly toward the molten metal exit *4c* but terminate at the level lower than the possible molten metal surface in the conduit *4a* at the time of reverse operation when the electromagnetic pump 4 or the travelling magnetic field push the molten metal into the container 1. In other words, the disposition of the partition walls *4b'* is such that they are entirely immersed into the molten metal 2 even when the travelling magnetic field is in reverse operation, while the lower ends thereof extend in the length enough to introduce the molten metal 2 into the container 1 through the central passageway P by means of the travelling magnetic field directed to the container 1.

When it is required, in the above mentioned embodiment of the present invention, to supply molten metal 2 into a mold through the molten metal exit *4c*, the AC coil *4e* in the electromagnetic pump 4 is energized to generate a travelling magnetic field in the direction designated by arrow line in FIG. 1.

When the molten metal supply is to be suspended, the travelling magnetic field reverse to the arrow line is generated in the AC coil *4e* by a suitable switch means. The functions derived from such reverse operation will be described below with reference to FIG. 2.

The traversal distribution of driving force in the electromagnetic pump 4 is as shown in graph (a) at the place where the partition walls *4b'* are not present. Since the driving force in the central portion is larger than that in the side portions, the molten metal 2 in the central portion commences to advance toward the container 1, and runs into the central passageway P defined by the partition walls 4b'. This flow of molten metal 2 in the central passageway P is curved from the partition walls *4b'* and pours intensively into the container 1 from the inner edge or lowermost portion of the partition wall *4b'*.

At this time the driving force generated by travelling magnetic field is distributed longitudinally along the electromagnetic pump 4 as shown in graph (b), which indicates that the driving force is weakend at the edge of the electromagnetic pump 4 due to the longitudinal edge effect. The driving force in the molten metal conduit *4a* is still further weakened because the eddy current in molten metal 2 is divided by the partition walls 4b' into branch currents in passageways P, P' thus resulting in the decrease of the effective driving force. However, the molten metal 2 introduced into the passageways P, P' is still under the influence of the driving force which greatly affects the prevention of molten metal solidification. Molten metal 2 introduced into the central passageways P pours into the container 1 by the driving force of travelling magnetic field in the central passageway P. In compensation for this flow, the circulation of molten metal 2 between the container 1 and the electromagnetic pump 4 can be stimulated by decreasing, as far as possible, the driving force applied to molten metal in the side passageways with relation to the driving force in the central passageway P. For the purpose of relatively decreasing the driving force in the side passageways P' directed to pressured molten metal in the container 1, the central passageway P is configurated to be larger in its width than that of the side passageways as shown in FIG. 2. The modifications thereof will be shown hereafter. So, the driving force is very small in the central passageway P and side passageways P', and consequently the flow of molten metal 2 directed upwardly to molten metal exit *4c* as shown by arrow line is generated in the side passageway P' wherein the driving force is so feeble. This flow serves to compensate the molten metal 2 which runs through the central passageway P and pours into the container 1. By such function of the reverse magnetic field it is made possible to successively exchange the molten metal 2 in the electromagnetic pump 4 with the molten metal of high temperature in the container 1, even at the time of suspension in teeming molten metal by electromagnetic pump 4.

Figure 4:
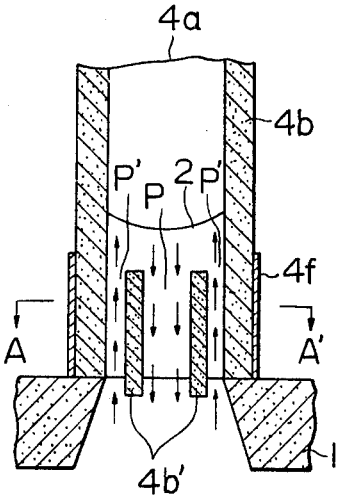
FIG. 4 is a sectional view of the second example of the present invention.
Figure 5:
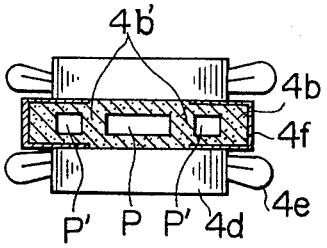
FIG. 5 is a sectional view taken along the line A—A′ in FIG. 4.

FIG. 4 and FIG. 5 indicate an improved construction according to the present invention for reducing the driving force applied to side passageways. As shown in these drawings, refractory walls *4b* which define the side passageways P' are covered by magnetic shielding plate such as copper plate *4f*. By the provision of this copper plate, the driving force caused by the travelling magnetic field and applied to the molten metal in the side passageway P' is remarkably weakened, and in turn the driving force directed to the container 1 in the central passageway P is relatively strengthened than that in the side passageways P'. Hence in this improved instance of the present invention the size or the width of both of central passageway P and side passageways P' do not affect the circulation of molten metal in contrary to the aforementioned first instance.

Figure 6:
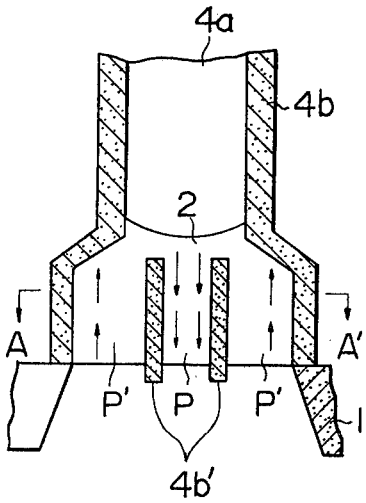
FIG. 6 is a sectional view of the third example of the present invention.
Figure 7:
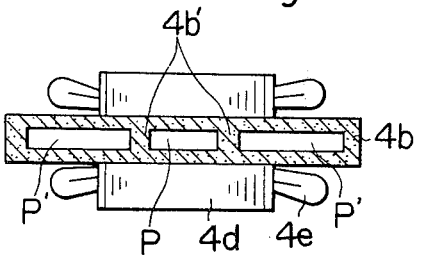
FIG. 7 is a sectional view taken along the line A—A′ in FIG. 6.

The next embodiment of the present invention is shown in FIG. 6 and FIG. 7, wherein the molten metal conduit *4a* is enlarged at the particular position corresponding to the longitudinal length of the partition walls *4b'*. According to such construction, the both sides of the enlarged portion of the conduit *4a* protrude laterally from the iron core *4d* for generating travelling magnetic field, thus substantially nullifying the drive force generated by the travelling magnetic field in side passageways P'. Therefore, in this case too, the proportion of the width of side passageways to that of central passageway does not affect the function of molten metal circulation.

Figure 9:
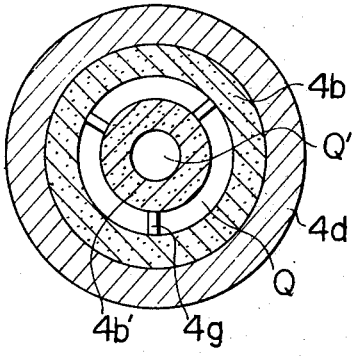
FIG. 9 is a sectional view taken along the line A—A′ in FIG. 8.
Figure 8:
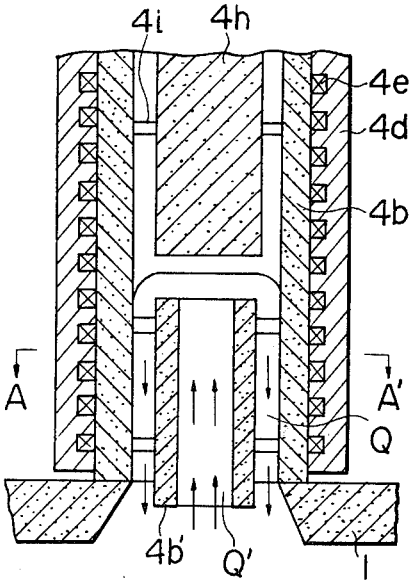
FIG. 8 is a sectional view of the fourth example of the present invention.

In these embodiments of the present invention, the cross section of the molten metal conduit is made rectangular in shape, and means for generating travelling magnetic field is located at least at one side of the conduit. But it is of course possible to have the travelling magnetic field arranged evenly arround the condity by using, for example, a cylindrical electromagnetic pump. As shown in FIG. 8 and FIG. 9, the cylindrical electromagnetic pump may have a partition wall *4b* of cylindrical configuration and is provided with a molten metal passageway Q extending between the outer circular face of the partition wall *4b'* and the inner circular face of the refractory wall 4*b*. Support limbs 4*g* serve to secure the partition wall 4*b'* to the refractory wall 4*b* to form a united construction.

It will be understood that the above mentioned construction shown in FIG. 8 and FIG. 9 serves to generate the circulation of molten metal which runs through the above mentioned passageway Q and the central passageway Q' defined by the partition wall 4*b'*. By virtue of such circulation, the replacement of molten metal in the container 1 with that in the electromagnetic pump is carried out, and the driving force in the passageway Q is by far larger than that in the passageway Q' because the passageway Q is exposed to the strong magnetism generated by the travelling magnetic field generator just adjacent thereto, when the travelling magnetic field is generated in the pump 4 toward the container 1.

As a result the molten metal is supplied into the container 1 through the passageway Q and, to compensate for the discharge of molten metal, the molten metal of high temperature in the container 1 is introduced into the electromagnetic pump 4 through the passageway Q' thus effecting a continuous replacement of the molten metal in the electromagnetic pump 4 with that in the container 1. Reference numeral 4*h* indicates a refractory member for guiding molten metal into the container, and reference numeral 4i indicates the support limb therefor.

The embodiments of the present invention as explained hereinbefore are directed to the apparatus for supplying molten metal to a mold through the molten metal outlet of an electromagnetic pump, wherein the electromagnetic pump extends upwardly and slantedly from the bottom of a side portion of a container. However, it is clear that the present invention is not limited to these embodiments but can be applied to any of the devices for controlling the discharge of molten metal from a container by means of an electromagnetic pump for generating travelling magnetic field.

As explained above, the present invention has developed the device for eliminating the defect of the former electromagnetic pump, that is, the drop of molten metal temperature in an electromagnetic pump. Thus the present invention solved the problem of replacing molten metal in the electromagnetic pump with that in the container, which otherwise can not be carried out at the time of suspension in supply. The difficulties due to the noticeable decrease of the driving force caused by the longitudinal edge effect at the lowermost or the connecting portion of the pump was overcome by the present invention.

In summary, the device according to the present invention is provided with the partition walls for forming two or three passageways to bring about the augmented gap of the effect of the travelling magnetic field. The molten metal in the electromagnetic pump is guided through the passageway subjected to strong magnetic field into the container, and the molten metal in the container is introduced through the passageway subjected to weak magnetic field into the electromagnetic pump. By virture of such construction, the molten metal discharged from the container through the travelling magnetic field can be always maintained in the same temperature as that in the container, and the danger of generating uneven structure in the finished article was eliminated in the process of teeming molten metal into a mold or the like.

We claim:

1. An apparatus for supplying molten metal which comprises:

a. a container means for receiving molten metal;

b. an electromagnetic pump including a molten metal conduit therein, said conduit including a plurality of adjacent passageways therein, said pump being connected to said container means, said electromagnetic pump including means for generating a traveling magnetic field directed away from said container to discharge the molten metal from the container through said conduit and by using the molten metal as a secondary conduit thereof, and said electromagnetic pump including means for alternatively generating a traveling magnetic field toward said container;

c. and means for causing perpetual replacement of the molten metal in the pump with that in the container when the traveling magnetic field is directed toward the container and for preventing solidification of said molten metal in said pump, said means for causing perpetual replacement of molten metal in the pump including partition walls disposed within said molten metal conduit and defining said passageways for said molten metal, said partition walls extending into said container whereby when the magnetic field is applied toward the container, the partition wall causes molten metal to be introduced into the container.

2. The apparatus for supplying molten metal set forth in Claim 1 wherein said partition walls comprise two partition walls dividing the molten metal conduit in the pump into three passageways consisting of a central passageway and two adjacent passageways, said molten metal conduit extending upwardly and including an outlet end, said partition walls extending into the container and toward said outlet end, and said partition walls being located such that when the travelling magnetic field is applied toward the container, the partition walls introduce molten metal into the container and are entirely immersed in molten metal, said travelling magnetic field completely immersing said partition wals, and said passageway being wider than said adjacent passageways.

3. An apparatus for supplying molten metal which comprises:

a. a container means for receiving molten metal;

b. an electromagnetic pump including a molten metal conduit therein, said pump being connected to said container means and generating a traveling magnetic field adapted to discharge the molten metal from the container by using the molten metal as a secondary conduit thereof;

c. and means for causing perpetual replacement of the molten metal in the pump with that in the container when the traveling magnetic field is directed toward the container and for preventing solidification of said molten metal in said pump, said means for causing perpetual replacement of molten metal in the pump including partition walls disposed within said molten metal conduit and defining passageways for said molten metal, said partition walls comprising two partition walls dividing the molten metal conduit in the pump into three passageways consisting of a central passageway and two adjacent passageways, said molten metal conduit extending upwardly and including an outlet end, said partition walls extending into the container and toward said outlet end, and said partition walls being located such that when the traveling magnetic field is applied toward the container, the partition walls introduce molten metal into the container and are entirely immersed in molten metal, and further including magnetism shielding members surrounding a portion of said electromagnetic pump, said portion having said adjacent passageways located therein.

4. An apparatus for supplying molten metal which comprises:

a. a container means for receiving molten metal;

b. an electromagnetic pump including a molten metal conduit therein, said pump being connected to said container means and generating a traveling magnetic field adapted to discharge the molten metal from the container by using the molten metal as a secondary conduit thereof;

c. and means for causing perpetual replacement of the molten metal in the pump with that in the container when the traveling magnetic field is directed toward the container and for preventing solidification of said molten metal in said pump, said means for causing perpetual replacement of molten metal in the pump including partition walls disposed within said molten metal conduit and defining passageways for said molten metal, said partition walls comprising two partitions walls dividing the molten metal conduit in the pump into three passageways consisting of a central passageway and two adjacent passageways, said molten metal conduit extending upwardly and including an outlet end, said partition walls extending into the container and toward said outlet end, and said partition walls being located such that when the traveling magnetic field is applied toward the container, the partition walls introduce molten metal into the container and are entirely immersed in molten metal, said molten metal conduit including an enlarged portion adjacent to said parition walls whereby the strength of traveling magnetic field in the adjacent passageways is decreased in combination with that in the central passageway.

5. An apparatus for supplying molten metal which comprises:

a. a container means for receiving molten metal;

b. an electromagnetic pump including a molten metal conduit therein, said pump being connected to said container means and generating a traveling magnetic field adapted to discharge the molten metal from the container by using the molten metal as a secondary conduit therof;

c. and means for causing perpetual replacement of the molten metal in the pump with that in the container when the traveling magnetic field is directed toward the container and for preventing solidification of said molten metal in said pump, said means for causing perpetual replacement of molten metal in the pump including partition walls disposed within said molten metal conduit and defining passageways for said molten metal, said partition wall means within the molten metal conduit having a hollow cylindrical tube configuration with an inner surface and said traveling magnitude field exerting influences on the entire inner surface of said cylindrical tube and along the length of said pump, said partition wall means extending into said container whereby when the traveling magnetic field is applied toward the container the partition wall causes molten metal to be introduced into the container but is entirely immersed in the traveling magnetic field.

* * * * *